US007942795B2

(12) United States Patent
Harris

(10) Patent No.: US 7,942,795 B2
(45) Date of Patent: May 17, 2011

(54) STRETCHING AND TONING DEVICE

(76) Inventor: Robert W. Harris, Durham, NC (US)

( * ) Notice: Subject to any disclaimer, the term of this patent is extended or adjusted under 35 U.S.C. 154(b) by 0 days.

(21) Appl. No.: 12/712,903

(22) Filed: Feb. 25, 2010

(65) Prior Publication Data

US 2010/0222192 A1 Sep. 2, 2010

Related U.S. Application Data

(60) Provisional application No. 61/208,647, filed on Feb. 27, 2009.

(51) Int. Cl.
*A63B 26/00* (2006.01)

(52) U.S. Cl. ..... 482/142; 482/140

(58) Field of Classification Search ..... 482/140, 482/91, 907, 142, 139, 51, 92, 148; D21/676, D21/696, 686, 662, 665
See application file for complete search history.

(56) References Cited

U.S. PATENT DOCUMENTS

| | | | | |
|---|---|---|---|---|
| 4,566,693 | A | 1/1986 | Seidentop et al. | |
| 4,703,929 | A | 11/1987 | Reed | |
| 4,717,148 | A | 1/1988 | Brewer | |
| 4,902,003 | A | 2/1990 | Buoni | |
| 4,927,139 | A * | 5/1990 | Taltre | 482/142 |
| 5,100,131 | A * | 3/1992 | Fong | 482/112 |
| 5,217,487 | A * | 6/1993 | Engel et al. | 606/240 |
| 5,531,658 | A * | 7/1996 | L. S. C. | 482/142 |
| 5,577,987 | A | 11/1996 | Brown | |
| 5,803,884 | A * | 9/1998 | Sharp | 482/142 |
| 5,833,587 | A | 11/1998 | Strong et al. | |
| 5,897,462 | A | 4/1999 | St. Germain | |
| 6,379,289 | B1 | 4/2002 | Gossie | |
| 6,569,069 | B1 * | 5/2003 | Linares | 482/148 |
| 6,843,759 | B2 * | 1/2005 | Wallerstein | 482/92 |
| 7,118,517 | B1 | 10/2006 | Hale | |
| 7,141,010 | B2 * | 11/2006 | Levine | 482/142 |
| 7,691,042 | B2 * | 4/2010 | Pandozy | 482/142 |
| 2008/0076649 | A1 * | 3/2008 | Chen | 482/140 |
| 2010/0099542 | A1 * | 4/2010 | Fernandez et al. | 482/142 |

* cited by examiner

*Primary Examiner* — Lori Baker
(74) *Attorney, Agent, or Firm* — David S. Bradin; Hultquist IP

(57) ABSTRACT

An exercise device that accommodates stretching and toning exercises otherwise performed with an exercise ball. The device comprises a stable support structure and a padded bench that rocks back and forth on the stable support structure safely and predictably in response to the user's movements. The support structure can take a variety of different forms, including an A-frame geometry, a triangular geometry, a T-shaped geometry, and in the form of a pedestal base. A user, during exercise, can support part of his weight on the bench, and cause the bench to rock back and forth by alternately relaxing and contracting selected muscles.

7 Claims, 7 Drawing Sheets

STRETCHING AND TONING DEVICE

This application is generally in the area of exercise equipment, and in particular, in the area of devices used for stretching and toning. This application claims priority to U.S. Provisional Application No. 61/208,647, the contents of which are hereby incorporated by reference for all purposes.

FIELD OF THE INVENTION

BACKGROUND

In recent years, exercise balls have become popular among people who want a simple, low impact device to assist them with stretching and toning exercises. These balls typically are 18 to 26 inches in diameter, made of a strong and resilient material, and filled with air.

A user may engage an exercise ball in many ways, but one exercise is particularly useful. During it, the user squats with feet on the floor so that he is face up and his back is supported by the ball. He then alternately extends and bends his legs, thereby alternately arching and flattening his back by rocking back and forth on the ball.

Although exercise balls are useful and effective, they do have some inherent problems. One problem is that a ball can be difficult to control. Because it is free to roll, it is unstable and can move in unintended directions. A related problem is that it allows an unrestricted range of motion, even though safe exercising demands a restricted and predictable range of motion. And a third problem is that it takes up a good deal of space when not in use.

A variety of modifications have been offered with the intention of solving one or more of these problems. For example, one approach has involved using a cup-like base into which an exercise ball fits, thereby restricting the movement of the ball during use. Another approach involves using an exercise ball that is rotatably mounted to a frame so that the ball rotates only about a single axis.

Other non-ball devices have been proposed that accommodate rocking motions similar to those that can be performed on exercise balls. For example, one approach has involved using an arcuate lounge that rocks back and forth on a surface in response to the user's leg and foot movements. Another exercise device incorporates a frame that supports a flexible chair, which rocks as the user contracts and relaxes selected muscles. Another abdominal exerciser incorporates a frame-supported bench that rocks side to side in response to a user's movements relative to the frame. And another exercise device includes arcuate frame elements that rock on a surface in response to a user's contraction and relaxation of the abdominal muscles.

Although prior art devices are useful, none has the functionality of an exercise ball while eliminating all of its inherent problems. Accordingly, there is clearly a need for an improved exercise device. Ideally, such a device would accomplish the following: a) simulate part of a ball's shape; b) be stable during use; c) allow a limited and predictable range of motion; and d) fold compactly and quickly for easy storage. The present invention provides such a device.

SUMMARY OF THE INVENTION

The present invention is an exercise device that accommodates the kinds of stretching and toning exercises that are possible with a ball. However, unlike a ball, the device has a stable base (a support structure) and a padded bench (which padded bench effectively serves as a portion of a ball) that rocks back and forth on the support structure safely and predictably in response to the user's movements. And, unlike a ball, the present device is, at least in a preferred embodiment, foldable for easy storage. The stable base can take a variety of different forms, including an A-frame geometry, a triangular geometry, a T-shaped geometry, and a pedestal.

In some embodiments, the device incorporates two frame elements that are generally upwardly extending. The frame elements are pivotably connected near their upper ends, thus allowing their lower ends to be separated to form a stable A-shaped base. A folding cross brace, similar to the cross brace found on step ladders, connects the two frame elements and locks them in their spread-apart position.

Pivotably mounted near the upper ends of the two frame elements is a bracket that supports an arcuate padded bench. The range of motion of the bench is limited by the cross brace, whose ends extend slightly beyond the A-shape formed by the two frame elements.

During exercise, a user would support part of his weight on the bench and cause the bench to rock back and forth by alternately relaxing and contracting selected muscles.

These and other features will be better understood with reference to the following Detailed Description.

DETAILED DESCRIPTION

Figure 1:
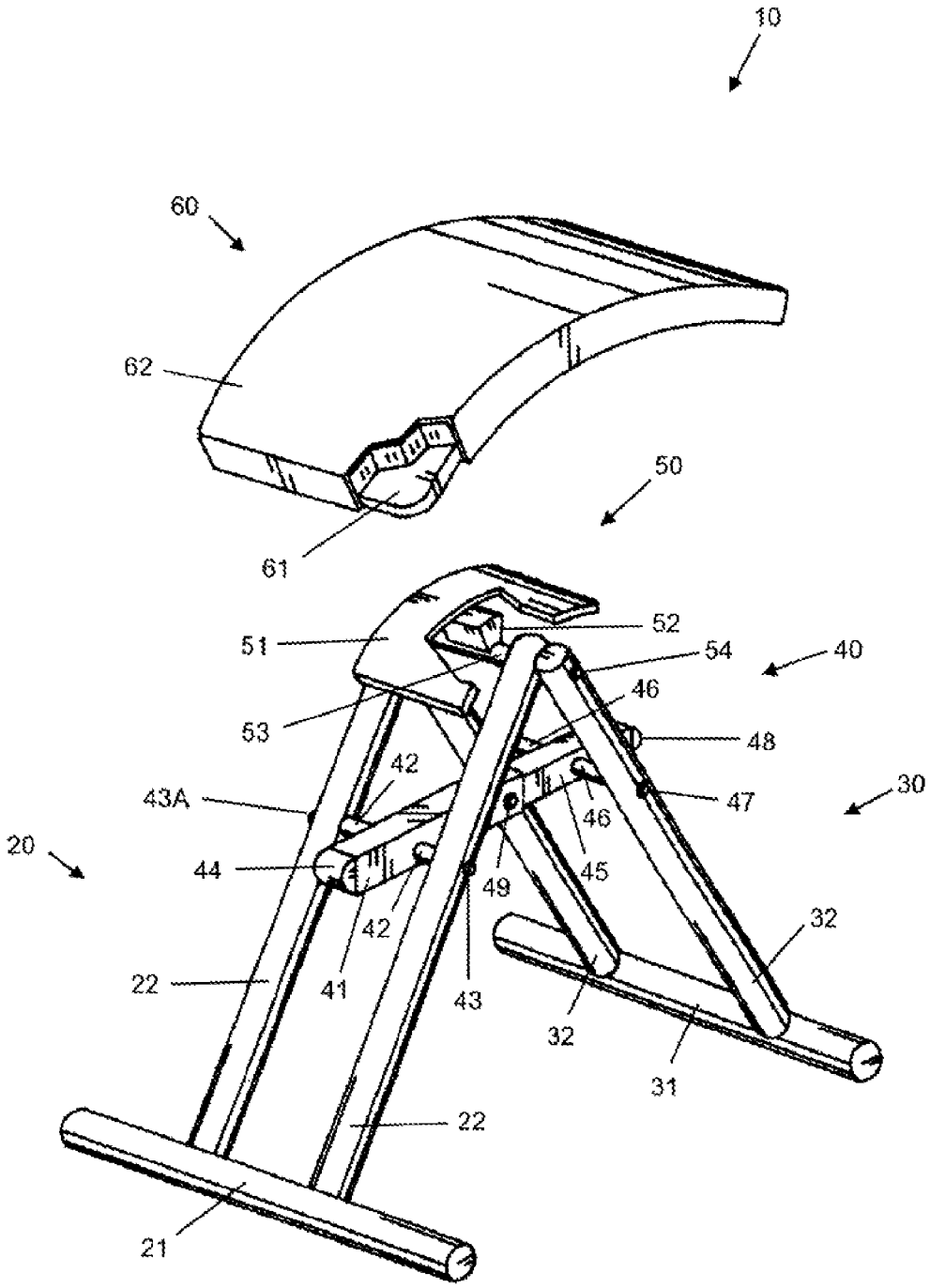
FIG. 1 is a perspective drawing of the exercise device embodying the invention, with parts exploded and broken away for clarity.
Figure 2:
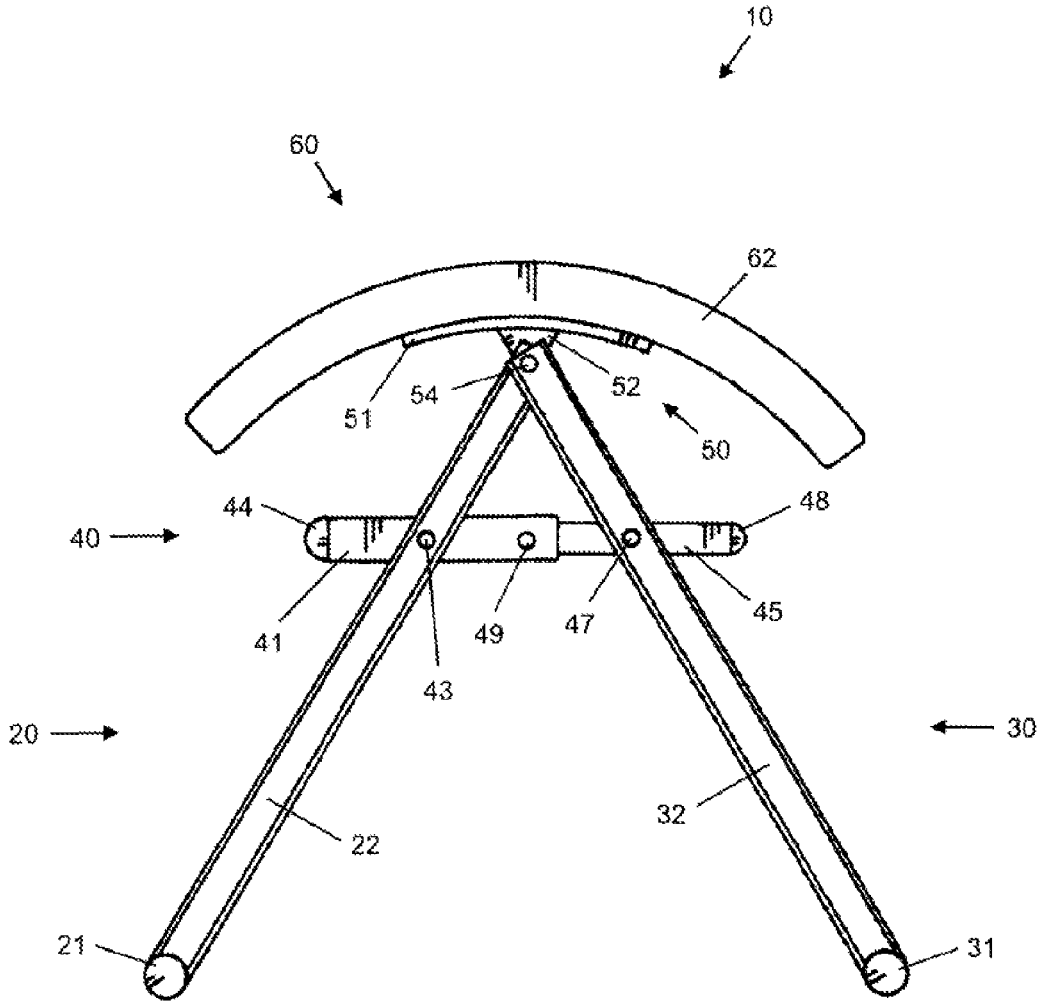
FIG. 2 is a side elevation of one embodiment of the exercise device, in which the stable base has an A-frame geometry.
Figure 3:
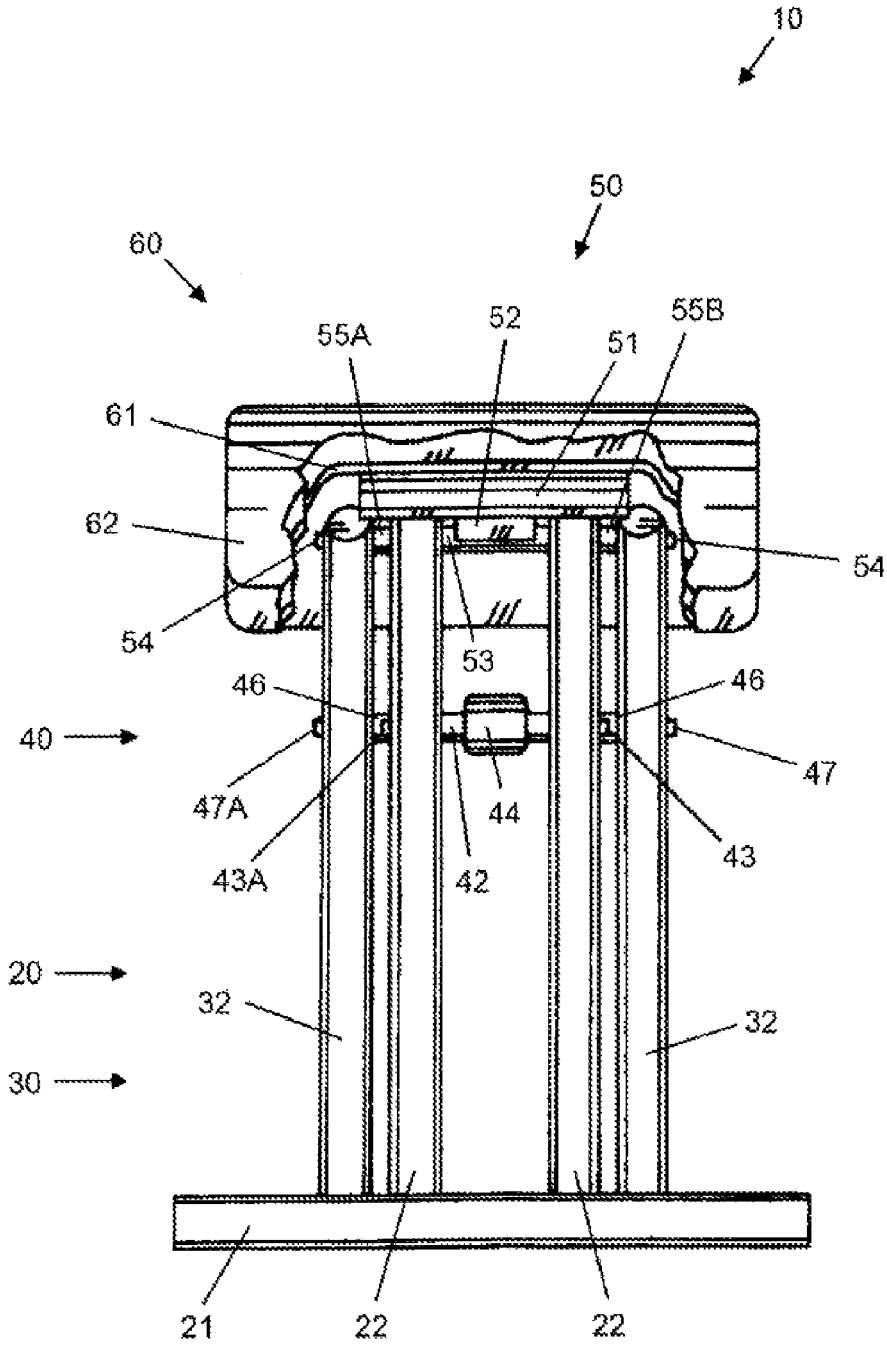
FIG. 3 is a front elevation of the exercise device, with parts broken away for clarity.
Figure 4:
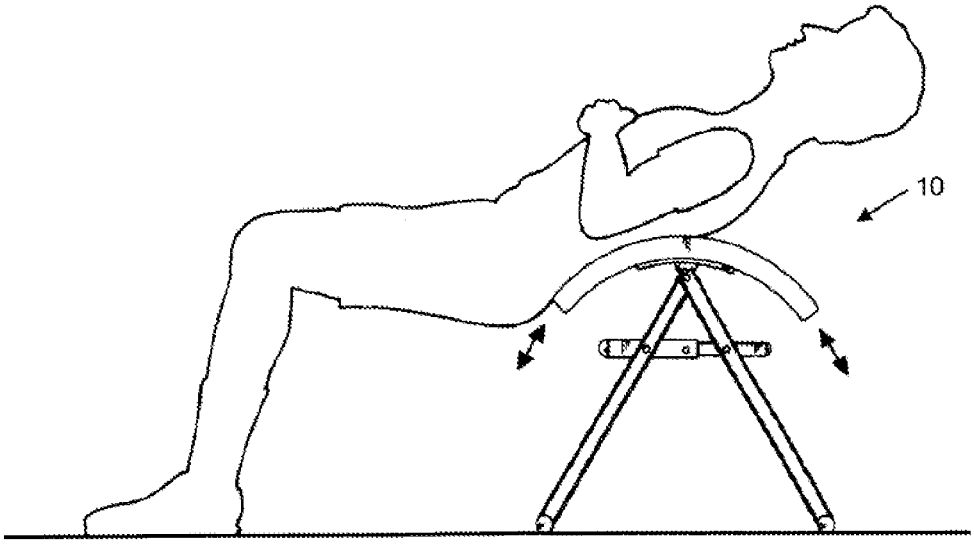
FIG. 4 is a side elevation of the exercise device showing one way in which a person could use it.

An apparatus for stretching and toning is disclosed. The apparatus includes an arcuate bench, pivotably attached to a fixed support structure, where the arcuate bench has a limited range of movement. In use, an individual rests a portion of his or her weight on the arcuate bench, ideally with one or more feet, knees, elbows, and/or hands on the floor on which the apparatus is placed. By limiting the range of movement of the arcuate bench, the apparatus ensures that the vector sum of forces is directed in a generally downward direction, thus inhibiting movement of the apparatus across the floor. By allowing the arcuate bench to pivot in response to movement by the user, the apparatus can simulate the effects of an exercise ball, while providing a more stable platform for use.

Several types of stable support structures can be used to support the arcuate bench and allow the bench to rotate. However, each support structure has the ability to limit the movement of the bench beyond a predetermined range, either by virtue of the components of the support structure, or by the addition of one or more stops and/or bumpers to the support structure.

As used herein, a bumper is a cushioning element, ideally made from rubber or plastic, present on the arcuate bench, a component of the support structure coming into contact with the bench, or on a stop, present on a component of the support structure. The intended purpose is to cushion the impact of the bench with the support structure or stop, but as it has some thickness, it will also limit the rotation of the arcuate bench. As used herein, a "stop" is an element that extends outwardly from the support structure or the arcuate bench, primarily to limit the rotation and/or movement of the arcuate bench.

Without such ability to limit the movement of the bench, the bench could, in theory, rotate 360 degrees. In the apparatus described herein, the total rotation of the arcuate bench is limited to about 50 to 70 degrees.

A-Frame Geometry

In one embodiment, the stable support structure is in the shape of an A-frame, and includes two frame elements, one on each side, connected by a cross brace positioned at or near the middle third of each of the frame elements. The cross brace provides stability to the support structure. In one aspect of this embodiment, the brace is fixed in place. In another aspect of this embodiment, the brace is designed to fold, or be removed, such that the apparatus can be folded for easy storage.

In one aspect of this embodiment, the cross brace is positioned in such a way that it can limit the rotation of the arcuate bench. In this embodiment, the cross brace can extend outwardly from the frame elements, and can include bumpers or other cushioned means on each end to limit the rotation of the arcuate bench. Ideally, in this embodiment, the bench is wider than the upper portion of the frame elements (i.e., the portion of the frame elements contacted by the arcuate bench during rotation). Alternatively, or in addition, the frame elements and/or the arcuate bench can include one or more bumpers, so as to cushion the impact when the bench comes into contact with the frame elements or the cross brace.

When the apparatus is set up for use, the frame elements are positioned at an angle between around 30 and 120 degrees, but preferably between around 60 and around 90 degrees, and meet at the top of the "A". A bracket is pivotably mounted at or near the upper ends of the frame elements, and the bracket is attached to an arcuate padded bench.

Triangular Geometry

In a second embodiment, the support structure is in a substantially triangular shape. It includes two side members, connected by a cross member at or near the base (i.e., within the bottom third of the side members).

The cross brace provides stability to the support structure. In one aspect of this embodiment, the brace is fixed in place. In another aspect of this embodiment, the brace is designed to fold, or be removed, such that the apparatus can be folded for easy storage.

In this embodiment, the cross brace is not positioned in such a way that it can limit the rotation of the arcuate bench. In this embodiment, the frame elements themselves, stops attached thereto, and/or the arcuate bench can include bumpers or other cushioned means to limit the range of motion of the arcuate bench. Ideally, in this embodiment, the bench is wider than the upper portion of the frame elements.

When the apparatus is set up for use, the frame elements are positioned at an angle between around 30 and 120 degrees, but preferably between around 60 and around 90 degrees, and meet at the top of the "A". A bracket is pivotably mounted at or near the upper ends of the frame elements, and the bracket is attached to an arcuate padded bench. The degree of rotation of the bench can be limited by the cross brace. The cross brace can include ends which extend slightly beyond the A-shape formed by the two frame elements. One or more of the frame elements, the cross brace, and/or the padded bench can include one or more bumpers, so as to cushion the impact when the bench comes into contact with the frame elements of the cross brace.

T-Shaped Geometry

In another embodiment, the support structure is shaped substantially like two inverted "T's", with a horizontal support beam connecting the bottom of the T's. The support beam in this embodiment includes a portion around which the bracket holding the arcuate bench is permitted to rotate. The support beam is parallel to the floor, but the sides of the apparatus (i.e., the "T-shaped" portions) can, individually, be perpendicular to the floor, or splayed outward up to around 45 degrees. By being splaying outward, the sides of the apparatus can provide increased stability, and can thus be preferred.

In one aspect of this embodiment, the support beam is cylindrical, and includes a narrower portion which is adapted to receive a bracket, which bracket holds the arcuate bench and permits the bench to rotate about the cylinder. In a second aspect of this embodiment, the support beam is cylindrical, and includes "stops" on either side of a bracket, where the bracket holds the arcuate bench, and fits around and rotates about the cylinder. In a third aspect of this embodiment, the support beam can be of substantially any shape, and a bracket is attached to the top of the support beam. The bracket is adapted so it can be attached to the arcuate bench.

The horizontal support beam provides stability to the support structure, but is not positioned in such a way that it can limit the rotation of the arcuate bench. In this embodiment, the frame elements themselves and/or the arcuate bench can include bumpers or other cushioned means to stop the movement of the arcuate bench. Ideally, in this embodiment, the bench is wider than the top portion of the support structure.

When the apparatus is set up for use, the "T's" are positioned at an angle between around 90 and 135 degrees, relative to the floor. The range of motion of the arcuate bench can be limited by the T's by attaching bumpers and/or stops to the T's at positions that come into contact with the arcuate bench. The bumpers are, ideally, parallel to the bottom of the inverted T's, and positioned in the upper third of the inverted T's, near to the support beam. Alternatively, or in addition, the arcuate bench can include "stops" that limit the degree of rotation of the bench when the bumpers come into contact with the inverted T's, so as to cushion the impact when the bench comes into contact with the frame elements of the cross brace.

Pedestal Base Geometry

In another embodiment, the support structure includes a vertical support beam attached to a flat base, which base can be a single solid element, or which can include a plurality of outwardly splayed legs. The vertical support beam in this embodiment includes a portion around which the bracket holding the arcuate bench is permitted to rotate. The support beam is perpendicular to the floor, and can be of substantially any desired form, i.e., cylindrical, cuboidal, pyramidal, and the like. The base can also be of substantially any desired shape, including circular, square, triangular, and the like.

The vertical support beam includes or is adapted to receive a bracket at or near the top of the support beam (i.e., the portion farthest from the base). The bracket holds the arcuate bench and permits the bench to rotate relative to the support beam. In this embodiment, the support beam and/or the arcuate bench can include bumpers and/or stops or other cushioned means to limit the degree of rotation of the arcuate bench. The bumpers and/or stops are sized and positioned along the vertical support beam in such a manner as to limit the rotation of the arcuate bench to a predetermined range.

When the apparatus is set up for use, the vertical support beam is positioned 90 degrees, relative to the floor. The range of motion of the arcuate bench is limited by bumpers and/or stops positioned on the vertical support beam and/or the arcuate bench.

The individual elements for each of these embodiments are described in detail below.

Frame Elements

The term "frame elements," as used herein, refers to the sides of the A-frame or triangular embodiments of the support structure, which are part of the support structure, and which sides are connected by a cross brace. The frame elements can be produced from solid materials, such as solid wood, plywood, steel, or plastic, or hollow materials such as metal or plastic tubing, or combinations thereof.

In the context of the A-frame and triangular embodiments, the frame elements can be connected to a base, which base is preferably wider than the arcuate bench. If the base is not wider than the arcuate bench, the apparatus can be less stable, which is less preferred.

In one embodiment of the frame elements, each frame element includes a single tube, a pair of tubes, or a planar or substantially planar solid piece, mounted to a base, which base can be formed from a solid or hollow material, such as a tube. As used herein, the term "tube" includes tubes which are cylindrical, square, triangular, and the like.

Where the frame elements include a pair of tubes, the tubes can be mounted to the base such that they are near the center of the base, or such that they are attached near the ends of the base, and are splayed inward as they approach the apex of the A-frame.

Where the frame elements are formed from a single tube or two tubes, the tubes can be attached to a base, which can be another tube. The attachment can be made, for example, by welding, by using nuts and bolts, by using threaded rods that insert into a threaded opening on the tube and the base, and the like. In the case of cylindrical base tubes, the cylindrical tube being attached to the base ideally has a "cove" adapted to match the shape of the base to which it is being attached. The two can be attached, for example, by inserting a bolt through the base, and into a threaded hole in the tube. However, other means of attachment are contemplated.

Alternatively, a single tube can be bent so as to provide a shape that includes a substantially flat portion which serves as a horizontal base, and two substantially equal (but, ideally, minor image) portions on either side of the substantially flat portion that extend upwardly toward the apex of the A-frame. In one aspect of this embodiment, the upwardly extending portions of the tube are bent inward for a predetermined distance, and then bent so that the remainder of the upwardly extending portions of the tube extend vertically, and, ideally, are parallel or substantially parallel to each other. It can be preferred to attach the cross brace to the parallel or substantially parallel portions of the two frame elements.

In embodiments where there are two upward tubes on each frame member (whether they are vertical, splayed inward, or splayed inward for a predetermined distance, and then bent to be parallel or substantially parallel), it can be advantageous for the two ends of one of the bent tubes to terminate with a distance between the ends of the tube that allows them to fit flush with the inside of the two ends of the other bent tube, while still having a sufficient space between the ends to accommodate a rotatable bracket. In this manner, a set of holes drilled at or near the top of the sets of tubes can be used to connect the two sets of tubes with a nut/bolt arrangement. The bracket can include a hole appropriately sized to receive the bolt. In this embodiment, the set-up of the apparatus includes positioning the top of one set of tubes within the top of the other set of tubes, positioning the rotatable bracket within the space between the narrower set of tubes, passing the bolt through the two sets of tubes and the bracket, and placing a nut, optionally with one or more washers and/or lock washers, onto the end of the nut. In this and other embodiments, a cotter pin can be used in place of a nut, provided the bolt includes an appropriately sized hold to receive the cotter pin.

In another embodiment, where a planar solid material is used as a frame element, the material can form its own base (i.e., the width of the base of the solid material can be wider than the width of the arcuate bench), and can taper as it reaches the top where the bracket is attached. In one aspect of this embodiment, each of the frame elements includes a complementary set of holes such that, when the two are positioned together, they form a hinge, which hinge is completed when a bolt is inserted through the hinge. A bracket can be attached over the hinge, or, alternatively, a space can be provided on both of the frame members where there are no holes, to as to permit the placement of a bracket with a similarly size hole in line to receive the bolt or threaded rod.

In another embodiment, one frame element has two upward tubes, and the other has one upward tube, where the single upward tube fits between the two upward tubes near their upper ends. In one aspect of this embodiment, the tubes connect by placing holes in each of the tubes, and passing a bolt or threaded rod through the tubes and attaching nuts to the bolts or ends of the threaded rod. In this embodiment, the bracket which holds the arcuate bench can either be positioned over where the tubes connect, or, if a sufficient space is provided, on one side or both sides of the single tube, to receive one or two brackets that include a hole sized to receive the bolt or rod. In this embodiment, the bracket(s) are free to rotate, and are mounted to the arcuate bench.

Cross Brace

A cross brace is used to stabilized the support structure, when the support structure is an A-frame or has a substantially triangular shape. As shown in the various figures in the "Example 1: Representative Apparatus" section, a cross brace can be attached to the frame elements, ideally by being positioned between two tubes and fastened in place using a nut/bolt arrangement or other suitable connecting means. In some embodiments, the cross-brace is fixed in position, and in other embodiments, the cross-brace is foldable or collapsible, to permit easy storage of the apparatus.

In one aspect of the embodiment where the cross brace is foldable, the cross brace includes two tubes, one of which fits inside the other. Each tube includes a point of attachment to the other tube, as well as a point of attachment to one of the frame elements. The attachment can be, for example, a threaded rod, a bolt, and the like. In one embodiment, the point of attachment of the two tubes is a quick release pin, which can be, for example, a detent pin or a spring loaded pin. In another embodiment, the cross bracket folds analogously to the bracket of a step ladder, around a hinge.

In use, the cross brace is attached to the frame elements such that the frame elements are stably positioned at an angle between around 30 and 120 degrees, but preferably between around 60 and around 90 degrees, and meet at the top of the "A".

The cross brace can, in some embodiments, extend beyond the frame elements. In these embodiments, the cross brace is intended to come into contact with the arcuate bench so as to limit the range of motion of the arcuate bench, and, ideally, includes bumpers at each end.

Horizontal Support Beam

In the embodiments where the support structure is a pair of inverted T's, the inverted T's are connected by a horizontal support beam. In one aspect of these embodiments, the inverted T's are connected to the support beam by, for example, threaded rods, bolts, or screws. In particular, the top of each of the inverted T's can include a threaded rod, which can be inserted into a threaded hole on each end of the support beam.

In another embodiment, the inverted T's and horizontal support beam are provided by bending a single tube into an inverted U-shape, and connecting each end of the U to a bottom support tube. In this embodiment, the U-shaped tube and bottom support rods can be attached in a similar manner as would be used if the ends of two inverted T's were attached to a horizontal support beam. In yet another embodiment, the unit is put together by attaching a horizontal support beam to two vertical tubes, which are then each attached to a horizontal base tube.

In this embodiment, the arcuate bench rotates about the support beam. As discussed above, embodiments that accommodate such rotation include:

a) providing a cylindrical support beam which includes a narrower portion adapted to receive a bracket, which bracket holds the arcuate bench and permits the bench to rotate about the cylinder;

b) providing a cylindrical support beam, which includes "stops" on either side of a bracket, where the bracket holds the arcuate bench, and fits around and rotates about the cylinder; and c) attaching a bracket to the top of the support beam, which bracket is adapted to pivotably engage the arcuate bench.

Where the cylindrical support beam includes a narrower portion adapted to receive a bracket, the bracket is cylindrical, of the same outer diameter as the rest of the cylinder, and when placed over the narrower portion, fits flush along the cylinder.

Ideally, the support beam is narrower in width than the width of the arcuate bench, at least at the position where the arcuate bench comes into contact with the inverted T's as the arcuate bench rotates about the support beam.

Vertical Support Beam

In the embodiments where the support structure includes a base and a vertical support beam, the base can be connected to the vertical support beam by, for example, threaded rods, bolts, or screws. The apparatus will be more stable if more than one threaded rod, bolt, or screw is used.

In this embodiment, the arcuate bench rotates about the top of the vertical support beam. There are several ways to have the arcuate bench rotate around the top of the vertical support beam, including:

a) providing a recess, such as a U-shaped recess, at the top of the vertical cylindrical support beam adapted to receive a bracket, which bracket holds the arcuate bench and permits the bench to rotate; and b) providing an attachment means, such as a threaded rod or a hole adapted to receive a threaded rod, where the bracket includes a hole adapted to receive a threaded or a threaded rod, respectively, and where the bracket further includes a means for rotating the arcuate bench once the bench is attached to the bracket.

Ideally, the support beam is narrower in width than the width of the arcuate bench, at least at the position where the arcuate bench comes into contact with the vertical support beam as the arcuate bench rotates about the support beam. The support beam also ideally includes bumpers attached at a predetermined positions so as to limit the range of motion of the arcuate bench as it rotates.

Bracket

The bracket is used to pivotably mount the arcuate bench to the support structure. It is positioned at or near the upper ends of the frame elements (when the support structure is an A-frame or of triangular shape), along the horizontal support beam, or at the top of the vertical support beam.

In a preferred embodiment, a single bolt cooperatively engages the top portion of the frame elements and the bracket, although the bracket can be attached to the top of one or both of the frame elements. Where the bracket is engaged by a bolt, the bolt allows for the arcuate bench to have freedom of rotation. Where the bracket is welded onto the frame elements, the bracket must include a rotatable means, such as a captive rod, to allow the arcuate bench to rotate.

Either the bracket can be attached to the arcuate bench as part of a unitary construction, or the arcuate bench can be attached to the bracket through other means, such as screws, bolds, threaded rods, and the like. Where the bracket is attached to the arcuate bench, the bracket ideally has a curved shape that matches the arc of the arcuate bench, allowing for a flush attachment.

Arcuate Bench

The arcuate bench is curved in the shape of an arc (hence, the term "arcuate"), and the degree of curvature of the arc is ideally between a 60 degree arc (i.e., a sixth of a circle) and a 180 degree arc (i.e., half of a circle), preferably around a 90 degree arc (i.e., a fourth of a circle). The curve is, ideally, substantially constant along the width of the arcuate bench.

The width of the bench is typically between about six and about eighteen inches, but ideally between about nine and about twelve inches. The length of the bench is typically between about six and about thirty inches, but is ideally between about twelve and about twenty-four inches.

Where the bench and the bracket are not of unitary construction, the bench includes one or more points of attachment such that it can be affixed to the bracket.

The bench ideally is formed of a material, such as plywood, metal, or plastic as a base, and includes one or more layers of foam over the base, optionally one or more layers of cotton batting over the foam layer(s), and a cover, which can be fabric, leather, vinyl, or the like, over the foam layer(s).

In one embodiment, the arcuate bench does not include a consistent curve, but rather, a curve of a more ergonomically or esthetically desired shape. For example, at all or part of the periphery along the width of the bench, the bench can roll upwards to create a cushioned barrier to minimize the risk of falling off of the apparatus and/or providing additional comfort to the user.

Bumper

Figure 7:
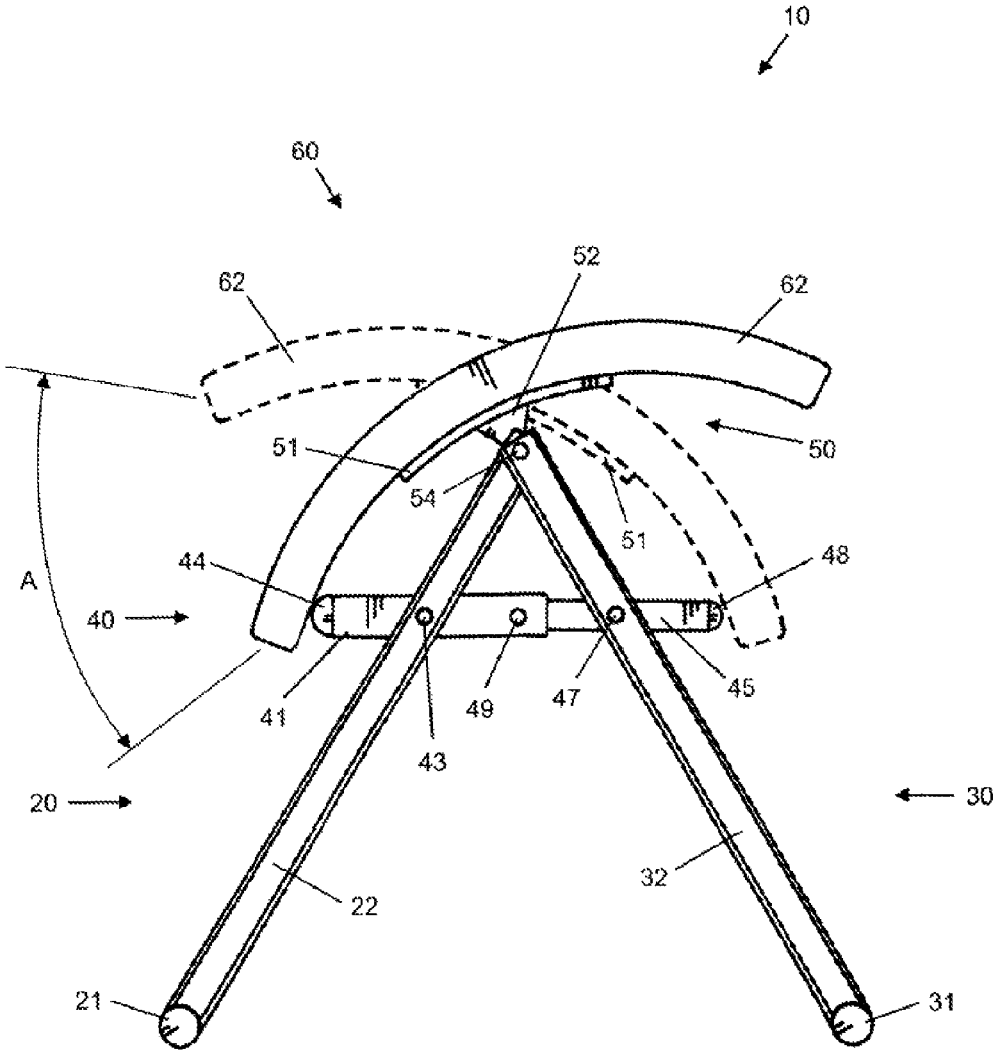
FIG. 7 is a side elevation of one embodiment of the device described herein, in which the degree of rotation of the arcuate bench is shown.

The bumpers are positioned on one or more of the vertical support element, horizontal support element, cross brace, and arcuate bench, so as to limit the range of motion of the arcuate bench to a predetermined range (i.e., as shown in FIG. 7, a predetermined range that totals about 50 to 70 degrees).

The bumpers can be attached directly to these components, or can be attached to an object attached to these components, so as to extend the distance from the components at which the bumpers come into contact with the other components (for example, the arcuate bench and the cross brace in the embodiment where the apparatus is in the shape of an A-frame).

The bumpers are ideally prepared from rubber or plastic, but can be prepared from any suitable material that cushions the impact of the arcuate bench and the other component with which it comes into contact.

Optional Additional Components

In one embodiment, the tubes that determine the height of the apparatus are designed to be raised and lowered to predetermined heights, by including, rather than a single tube, a pair of telescoping tubes, with holes positioned along one or both tubes, with pins or rods passed through the holes, or, alternatively, by providing the innermost tube with spring-loaded pins that extend through holes in the outermost tube.

In another embodiment, the apparatus includes handles positioned in a predetermined position along the support structure, or extending outwardly from the bench, so as to provide additional support for the user.

Other Information

The height of the apparatus, from the floor to the top of the arcuate bench, is typically in the range of between about twelve inches to about thirty inches, more typically between about sixteen and twenty inches, and, ideally, around eighteen inches.

Other aspects of this invention which should be considered in all its novel aspects will become apparent from the following non-limiting example with reference to the accompanying drawings.

EXAMPLE 1

Representative Apparatus

Referring now to FIGS. 1-7 of the drawings, the exercise device embodying the invention generally is designated 10. Device 10 comprises frame elements 20 and 30 which are connected by folding cross brace 40. Bracket 50, pivotably mounted near the upper ends of frame elements 20 and 30, supports bench 60. During exercise, bench 60 rocks back and forth in response to the user's contraction and relaxation of selected muscle groups. A detailed description of the structure of device 10 will now be set forth.

Device 10 comprises frame element 20, which includes two generally upwardly extending legs 22. At least one transverse support 21 connects legs 22. Transverse support 21 either can be fixedly attached to legs 22 by welding or other suitable means, or can be a portion of a one-piece bent support that includes legs 22. Legs 22 include apertures 22A (not shown in the FIGS.), the purpose of which will be made clear below.

Device 10 further comprises frame element 30, which includes two generally upwardly extending legs 32. At least one transverse support 31 connects legs 32. Transverse support 31 either can be fixedly attached to legs 32 by welding or other suitable means, or can be a portion of a one-piece bent support that includes legs 32. Legs 32 include apertures 32A (not shown in the FIGS.), the purpose of which will be made clear below.

Cross brace 40 comprises support 41, which has a square U-shaped cross section and which has proximal and distal ends. Support 41 includes aperture 41A near its distal end and aperture 41B near its proximal end (not shown in the FIGS.). Tube 42 extends transversely through aperture 41A, and is fixedly connected to support 41. Support 41 is pivotably connected to legs 22 by bolt 43, which cooperatively engages tube 42 and apertures 22A. Nut 43A holds bolt 43 in place. Bumper 44, made of rubber or other suitable material, is fixedly attached to the distal end of support 41.

Cross brace 40 further comprises support 45, which has a square cross section and which has proximal and distal ends. Support 45 includes aperture 45A near its distal end and aperture 45B near its proximal end (not shown in the FIGS.). Tube 46 extends transversely through aperture 45A, and is fixedly connected to support 45. Support 45 is pivotably connected to legs 32 by bolt 47, which cooperatively engages tube 46 and apertures 32A. Nut 47A holds bolt 47 in place. Bumper 48, made of rubber or other suitable material, is fixedly attached to the distal end of channel 45.

Pin 49 cooperatively engages apertures 41B and 45B, thereby pivotably connecting supports 41 and 45.

Bracket 50 comprises arcuate plate 51. Connector 52 is fixedly connected to the underside of plate 51 and to tube 53. Bolt 54 cooperatively engages tube 53, apertures 22B, and apertures 32B, thereby pivotably connecting bracket 50 to frame elements 20 and 30. Bushings 55A and 55B ensure adequate separation of legs 22 and 32.

Bench 60 comprises arcuate platform 61, made of plywood or other suitable material, that is fixedly attached to plate 51. Foam pad 62 is fixedly attached to platform 61.

Figure 5:
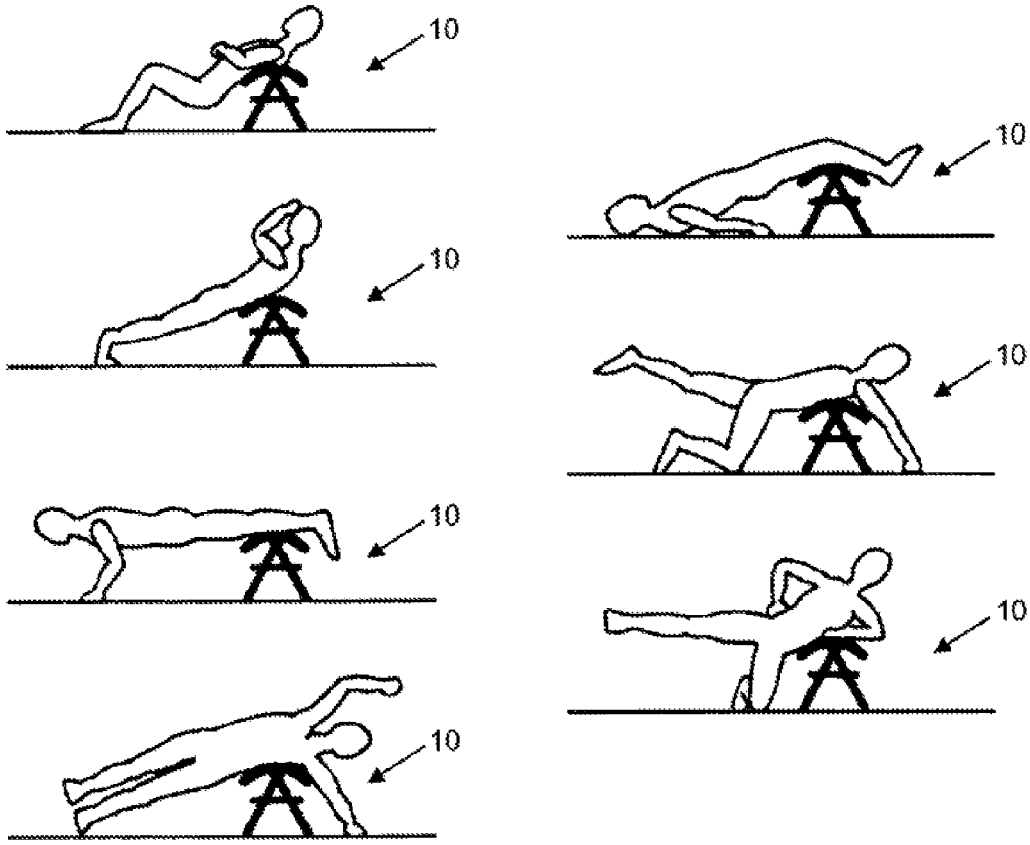
FIG. 5 is a schematic illustration of various exercises that can be performed using the device.

Representative examples of how the device can be used are shown in FIG. 5. as shown in the figure, the various exercised minor those that can be performed with an exercise ball.

Figure 6:
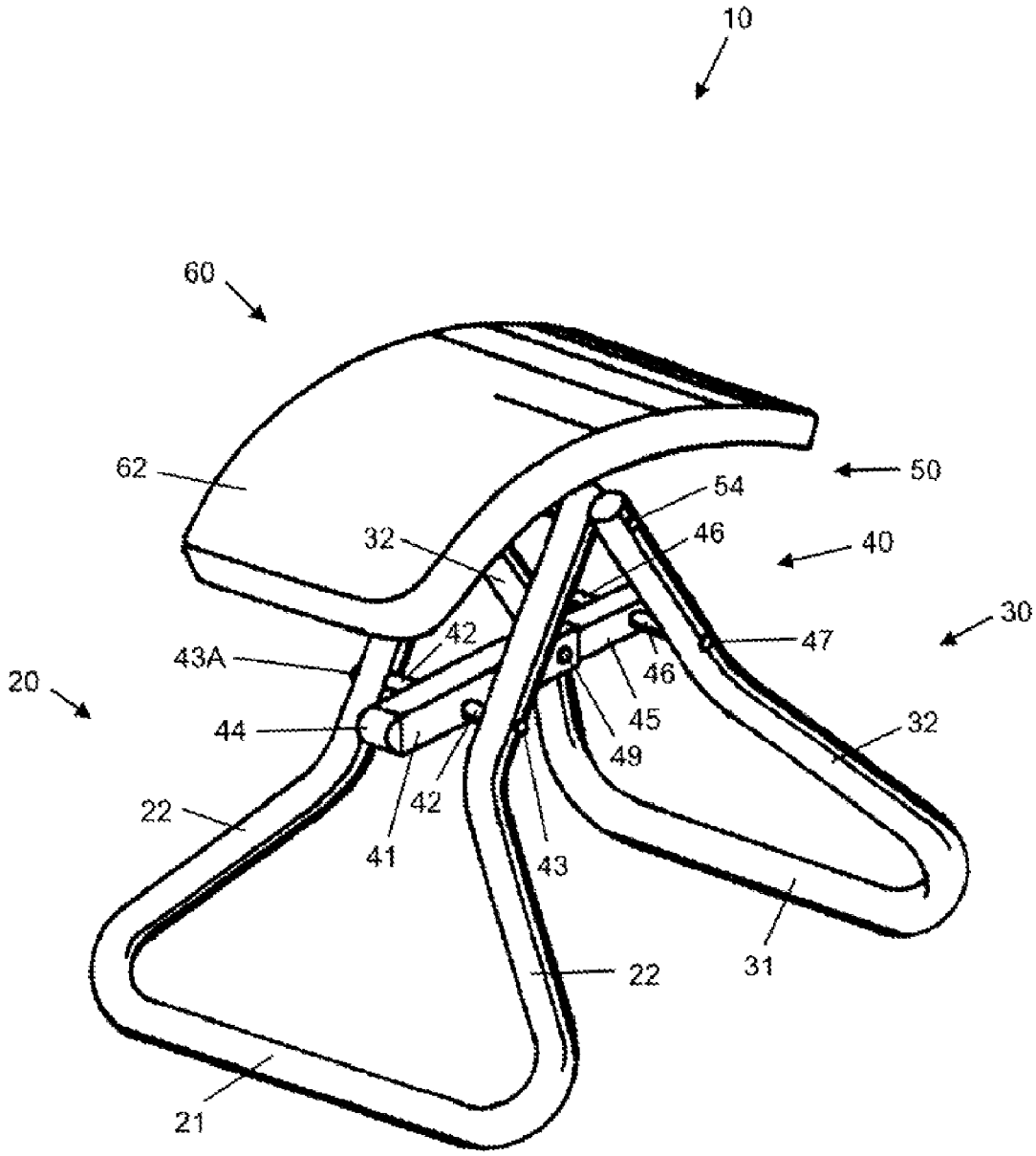
FIG. 6 is a perspective drawing of a second embodiment of the exercise device, in which the stable base has an A-frame geometry, and in which each of the frame members is formed by bending a single tube.

In an alternative embodiment, the frame elements 20 and 30 can each be formed out of a single bent tube; connector 52 can be replaced with any type of suitable connector; cross brace supports 41 and 45 can be replaced with suitable tubes, rods, or straps. An embodiment where frame elements 20 and 30 are each formed out of single bent tube is shown in FIG. 6. The parts and corresponding part numbers of FIG. 7 match those in FIG. 2, except that where FIG. 2 refers to parts 21 and 22, and parts 31 and 32 as separate parts that are connected to form frame elements 20 and 30, respectively, FIG. 6 refers to the flat portions of the tubes in contact with the floor as parts 21 and 31, and the bent portions of the tubes extending upward as parts 22 and 32, wherein single tubes form frame elements 20 and 30.

FIG. 7 is provided to show the range of rotation that the arcuate bench is permitted (A in FIG. 7). As shown in the figure, the ends of the cross brace (41 and 45) include bumpers (44 and 48, respectively) which come into contact with the arcuate bench and limit its degree of rotation, which helps to ensure that the stable base does not move during the device's intended use. The parts and corresponding part numbers of FIG. 7 match those in FIG. 2.

It is clear that various details of the invention may be changed without departing from the scope of the invention.

The invention claimed is:

1. An apparatus for stretching and toning, wherein the apparatus comprises:

a) a fixed support structure with an A-frame geometry, comprising:

i) two frame elements, one on each side of the A-frame, and ii) a cross brace positioned at or near the middle third of each of the frame elements, b) a bracket pivotably mounted at or near the upper ends of the frame elements, wherein the pivoting is in the direction of the frame elements, and c) an arcuate padded bench attached to the bracket, wherein the cross brace connects the two frame elements, and provides stability to the support structure wherein the fixed support structure limits the range of movement of the arcuate bench as the bracket, to which the arcuate bench is attached, is pivoted.

2. The apparatus of claim 1, wherein the cross brace is fixed in place.

3. The apparatus of claim 1, wherein the cross brace is foldable or removable.

4. The apparatus of claim 1, wherein the cross brace comprises two ends, which ends extend past the frame elements, and wherein either the cross brace comprises a bumper on one or both of the ends, or the arcuate bench comprises a bumper in one or more positions that come into contact with the cross brace or the support support structure.

5. The apparatus of claim 1, wherein the frame elements are positioned at an angle between around 60 and around 90 degrees, and, when connected by the cross brace, form a shape that resembles an "A".

6. The apparatus of claim 1, wherein as the bracket to which the arcuate bench is attached is pivoted, the arcuate bench proceeds along a path of rotation, and wherein the arcuate bench comes into contact with the cross brace at predetermined positions along said path of rotation.

7. The apparatus of claim 1, wherein the fixed support structure further comprises one or more stops affixed thereto, wherein the one or more stops limit the range of movement of the arcuate bench as the bracket, to which the arcuate bench is pivotably attached, is pivoted.

* * * * *

UNITED STATES PATENT AND TRADEMARK OFFICE

CERTIFICATE OF CORRECTION

PATENT NO. : 7,942,795 B2
APPLICATION NO. : 12/712903
DATED : May 17, 2011
INVENTOR(S) : Robert W. Harris It is certified that error appears in the above-identified patent and that said Letters Patent is hereby corrected as shown below:

Column 5, line 46: “minor image” should be -- mirror image --.

Column 8, line 47: “esthetic” should be -- aesthetic --.

Column 11, line 4 (claim 4): “support support structure” should be -- support structure --.

Signed and Sealed this
Fifth Day of July, 2011

David J. Kappos

David J. Kappos
*Director of the United States Patent and Trademark Office*